US006344867B2

(12) United States Patent
Inui

(10) Patent No.: US 6,344,867 B2
(45) Date of Patent: Feb. 5, 2002

(54) THERMAL PRINTING METHOD AND THERMAL PRINTER CAPABLE OF EFFICIENT TRANSFER OF DATA

(75) Inventor: Fuyuki Inui, Saitama (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/726,017

(22) Filed: Nov. 30, 2000

(30) Foreign Application Priority Data

Nov. 30, 1999 (JP) ..... 11-340253

(51) Int. Cl.[7] ..... B41J 2/355
(52) U.S. Cl. ..... 347/183
(58) Field of Search ..... 347/183, 181, 347/188, 189, 190, 191, 194–195; 358/503, 502, 521, 455–456, 461, 298; 400/120.05, 120.08, 120.02, 120.03, 120.06, 120.07, 120.09, 120.11

(56) References Cited

U.S. PATENT DOCUMENTS 5,587,732 A * 12/1996 Kokubo ..... 347/183
5,680,168 A * 10/1997 Kokubo et al. ..... 347/175
6,220,687 B1 * 4/2001 Takahashi et al. ..... 347/5

* cited by examiner

*Primary Examiner*—N. Le
*Assistant Examiner*—K. Feggins
(74) *Attorney, Agent, or Firm*—Sughrue Mion, PLLC

(57) ABSTRACT

A head driver for thermal printing drives plural heating elements in a heating element array according to heating data for respectively the plural heating elements, to record dots of one line thermally by heating color thermosensitive recording material. A first data train is output, including gradation level data of gradation levels 0, 2, 4, . . . , 510. One-line image data for plural pixels in the one line is serially compared with the gradation level data in the first data train, so as to create even number gradation heating data in a serial signal form. Simultaneously with the first data train, a second data train is output, including gradation level data of gradation levels 1, 3, 5, . . . , 511. The one-line image data is serially compared with the gradation level data in the second data train, so as to create odd number gradation heating data in a serial signal form. After transfer to the head driver, the even number gradation heating data is converted into a parallel signal form. Also, the odd number gradation heating data is converted into a parallel signal form. The heating elements are supplied with respectively a drive signal by alternately reading the even and odd number gradation heating data.

17 Claims, 10 Drawing Sheets

THERMAL PRINTING METHOD AND THERMAL PRINTER CAPABLE OF EFFICIENT TRANSFER OF DATA

BACKGROUND OF THE INVENTION

1. Field of the Invention

The present invention relates to a thermal printing method and thermal printer, and more particularly, relates to a thermal printing method and thermal printer capable of efficient transfer of data and in which reproducibility of gradation can be high also at a high printing speed without being lowered.

2. Description Related to the Prior Art

As known examples of thermal recording, there are thermal transfer recording and direct thermal recording. In the thermal transfer recording, a thermal head applies heat to ink film and transfers ink to recording material. In the direct thermal recording, a thermosensitive type of the recording material is used and heated by the thermal head to develop color. In both types of the thermal recording, the thermal head in the thermal printer includes a plurality of heating elements in an array extending in a main scan direction. One of the thermal head and the recording material is fed to the remaining one of them in a sub scan direction, while the heating elements are driven to record an image to the recording material one line after another. For the thermal recording, heating data is referred to for controlling heat to be generated by the heating elements. So density of dots on the recording material is varied to reproduce gradation of pixels with fidelity.

A full-color type of the thermal printer is for use with a full-color type of the recording material, which is constituted by a support, cyan, magenta and yellow thermosensitive coloring layers, and a protective layer, all overlaid in sequence. The thermosensitive coloring layers are different in heat energy required for developing color. Higher heat energy is required according to the depth of each position of the coloring layers in the thermal printer. The coloring layers are heated selectively. Before the second and third of the coloring layers are heated, respectively the first and second of the coloring layers are subjected to application of ultraviolet fixation rays, and are prevented from further developing the color. The three colors are recorded to the coloring layers so as to print a full-color image to the recording material.

To record each one dot to the coloring layers, the heating elements apply bias heat energy to the recording material, the bias heat energy being enough for heating the recording material to a state directly short of starting color development. After the bias heating, the heating elements apply gradation heat energy to the recording material, the gradation heat energy being determined by density at which each color should be developed. This combination of the bias heating and gradation heating records a dot by coloring each one of pixels, which are virtually defined on a surface of the recording material as quadrilateral cells arranged in a matrix form.

The thermal printer includes a frame memory, to which image data from a digital still camera, personal computer or the like is written. At the time of writing the image data, one-line image data is read from the frame memory and written to a line memory. Then a comparator compares heating data with gradation level data which is stepped up one by one. The comparator outputs the heating data of a serial signal as a result of the comparison, which is transferred to the thermal head.

The thermal head includes the heating element array and a driver, which controls heat energy for each of the heating elements according to the heating data. The driver converts the heating data of the serial signal into a parallel signal, and turns on and off the heating elements.

In the thermal printer mentioned above, the image data in 256 gradation levels is converted into the serial signal and transferred to the thermal head. To this end, comparison is effected for 256 times between the image data and the gradation level data, to transfer result of the comparison serially. The number of times of the transferring process of the heating data for the one line is 256. In other words, the number of times of the transferring process is equal to the number of the gradation levels for the maximum density in of the image data. If it is intended to raise reproducibility of the gradation, for example from the 256 gradation levels to 512, then the data transferring time becomes longer, and becomes twice as long as that according to the 256 gradation levels. There occurs a problem in that the printing speed is decreased.

SUMMARY OF THE INVENTION

In view of the foregoing problems, an object of the present invention is to provide a thermal printing method and thermal printer in which reproducibility of gradation can be high also at a high printing speed without being lowered.

In order to achieve the above and other objects and advantages of this invention, a heating element array has plural heating elements. A head driver drives the plural heating elements according to heating data for respectively the plural heating elements, to record dots of one line thermally by heating thermosensitive recording material. For thermal printing, a line memory stores one-line image data for plural pixels in the one line. An even number gradation counter sequentially outputs gradation level data of gradation level N and gradation level data of gradation levels changed serially by two from the gradation level N, where N is an integer. A first comparator serially compares the one-line image data with the gradation level data from the even number gradation counter, so as to create even number gradation heating data in a serial signal form. An odd number gradation counter is operated in synchronism with the even number gradation counter, for sequentially outputting gradation level data of gradation level N+1 and gradation level data of gradation levels changed serially by two from the gradation level N+1. A second comparator serially compares the one-line image data with the gradation level data from the odd number gradation counter, so as to create odd number gradation heating data in a serial signal form. The head driver includes a first converter for converting the even number gradation heating data into a parallel signal form. A second converter converts the odd number gradation heating data into a parallel signal form. A drive signal generator supplies the heating elements with respectively a drive signal by alternately reading the even and odd number gradation heating data from the first and second converters.

According to a preferred embodiment, the first and second converters comprise first and second shift registers.

Furthermore, a strobe signal generator generates a strobe signal at a regular period. Also, N=0. When P strobe signals are generated after each of the gradation level data is output, the even and odd number gradation counters output a succeeding one of the gradation level data at a gradation level increased serially, where P is an integer equal to or more than one.

The drive signal generator includes an even number counter for generating an even count signal if the strobe signal number is even. A first latch array is connected with the first shift register, for latching the even number gradation heating data in response to the even count signal. An odd number counter generates an odd count signal if the strobe signal number is odd. A second latch array is connected with the second shift register, for latching the odd number gradation heating data in response to the odd count signal. An OR gate array obtains integer gradation heating data in a parallel signal form by OR operation of the even and odd number gradation heating data from the first and second latch arrays, to determine the drive signal according thereto.

According to another preferred embodiment, a line memory stores one-line image data for plural pixels in the one line. An even number gradation counter sequentially outputs gradation level data of gradation level N and gradation level data of gradation levels changed serially by two from the gradation level N, where N is an integer. A first comparator serially compares the one-line image data with the gradation level data from the even number gradation counter, so as to create even number gradation heating data in a serial signal form. An odd number gradation counter is operated in synchronism with the even number gradation counter, for sequentially outputting gradation level data of gradation level N+1 and gradation level data of gradation levels changed serially by two from the gradation level N+1. A second comparator serially compares the one-line image data with the gradation level data from the odd number gradation counter, so as to create odd number gradation heating data in a serial signal form. A combined heating data generator creates combined heating data in a serial signal form according to the even and odd gradation heating data, the combined heating data being any one of first, second and third information different from one another. The head driver includes a decoder for converting the combined heating data into even and odd gradation heating data. A first converter converts the even number gradation heating data into a parallel signal form. A second converter converts the odd number gradation heating data into a parallel signal form. A drive signal generator supplies the heating elements with respectively a drive signal by alternately reading the even and odd number gradation heating data from the first and second converters.

The combined heating data generator includes a first latch circuit for latching the even number gradation heating data in the serial signal form to output the first or second information in a binary manner. A second latch circuit latches the odd number gradation heating data in the serial signal form to output the first or second information in a binary manner. An information generator circuit is operated if outputs from the first and second latch circuits are equal to one another, for outputting the first or second information in a through output manner according to the outputs of the first and second latch circuits, and operated if the outputs from the first and second latch circuits are different from one another, for outputting the third information, the first, second and third information constituting the combined heating data.

The combination of the even and odd gradation heating data is any one of 00, 01 and 11, and the combined heating data is the first information if the combination is 00, is the second information if the combination is 01, and is the third information if the combination is 11.

The first information is 0, the second information is −1, and the third information is 1.

BRIEF DESCRIPTION OF THE DRAWINGS

The above objects and advantages of the present invention will become more apparent from the following detailed description when read in connection with the accompany wings, in which.

DETAILED DESCRIPTION OF THE PREFERRED EMBODIMENT(S) OF THE PRESENT INVENTION

Figure 1:
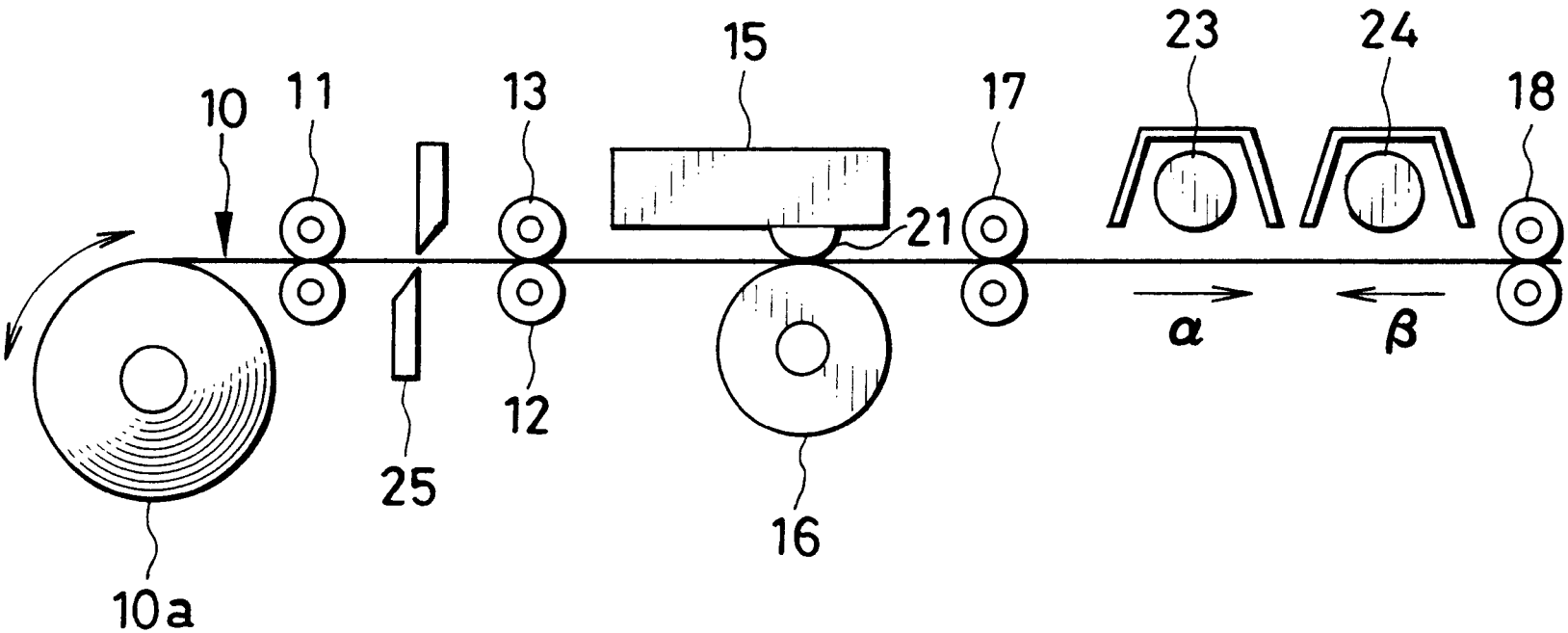
FIG. 1 is an explanatory view illustrating a color thermal printer.

In FIG. 1, a color thermal printer is depicted. Color thermosensitive recording material 10 in a form of continuous sheet is supplied as a roll 10*a*. The thermal printer includes a thermal head 15, to which the recording material 10 is fed by a feeder roller set 11, a capstan roller 12 and a nip roller 13. A platen roller 16 is opposed to the thermal head 15 with respect to a path for the recording material 10, and positions the recording material 10 in tight contact with the thermal head 15. Also, there are feeder roller sets 17 and 18, which feed the recording material 10 in a printing direction α and reverse direction β in operation additional to the capstan roller 12 and the platen roller 16.

As is well-known in the field of the thermal recording, the recording material 10 includes a support, cyan, magenta and yellow thermosensitive coloring layers overlaid on the support, and a protective layer on the yellow coloring layer. The magenta coloring layer has optical fixability to ultraviolet rays of which a wavelength peaks at 365 nm. The yellow coloring layer has optical fixability to visible violet rays of which a wavelength peaks at 420 nm. Due to the positions of the coloring layers, the yellow coloring layer only requires the lowest heat energy to develop color. The cyan coloring layer requires the highest heat energy to develop color. Bias heat energy, which is applied to heat the coloring layers to a state directly short of starting color development, is different between the coloring layers. For coloring of yellow in a pixel, the recording material 10 is supplied with yellow bias heat energy at a constant value, and also gradation heat energy determined according to coloring density of the pixel.

In feeding the recording material 10 in the printing direction for the first time, the thermal head 15 records a yellow image to the recording material 10. A magenta image is recorded in the second feeding. A cyan image is recorded in the third feeding. Finally, a full-color image is recorded according to three-color frame-sequential recording.

A heating element array 21 is incorporated in the thermal head 15 directed downwards, and includes heating elements R1–R1024 arranged in a main scan direction perpendicular to a sub scan direction or the feeding direction of the recording material 10. During the recording, the heating element array 21 is kept pressed on the recording material 10 supported on the platen roller 16.

A yellow fixer lamp 23 and a magenta fixer lamp 24 are arranged in a position downstream from the feeder roller set 17 in the printing direction a. The yellow fixer lamp 23 emits near ultraviolet rays or visible rays of which a wavelength peaks at approximately 420 nm. The magenta fixer lamp 24 emits near ultraviolet rays or visible rays of which a wavelength peaks at approximately 365 nm. The yellow fixer lamp 23 is turned on in the yellow recording to fix the yellow coloring layer in the recording material 10 immediately after being heated. In the magenta recording, the magenta fixer lamp 24 is turned on to fix the magenta coloring layer in the recording material 10 immediately after being heated. The cyan coloring layer does not have photochemical fixability because it cannot develop color under a normally preserved condition. After the thermal recording and fixation, a full-color image is obtained. There is a cutter 25 which is actuated to cut the recording material 10 from the recording material roll 10*a* after the recording operation, so that the recording material 10 is ejected from the printer.

Figure 2:
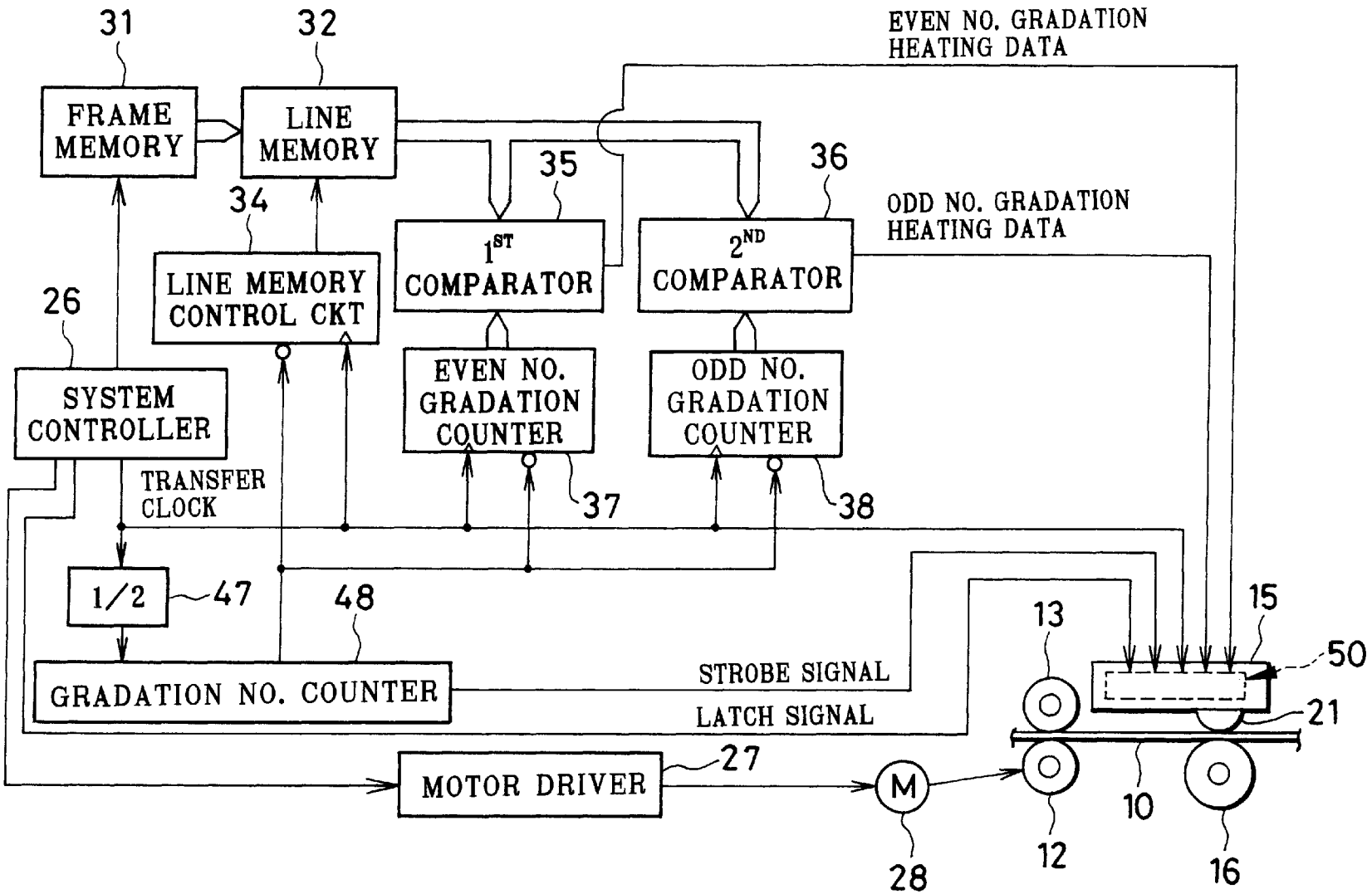
FIG. 2 is a block diagram illustrating the thermal printer.

In FIG. 2 illustrating circuits in the thermal printer, a system controller 26 controls components for feeding and printing according to predetermined sequences. The feeding component is constituted by a motor driver 27, a stepping motor 28 and the capstan roller 12. The motor driver 27 generates motor driving pulses to drive the stepping motor 28. Rotations of the stepping motor 28 are transmitted to the capstan roller 12 for its rotations. The recording material 10 is nipped by the capstan roller 12 and the nip roller 13. While the capstan roller 12 rotates forwards, the recording material 10 is fed in the printing direction α. While the capstan roller 12 rotates backwards, the recording material 10 is fed in the reverse direction β.

The printing component is constituted by a frame memory 31, a line memory 32, a line memory control circuit 34, a first comparator 35 for even number gradation comparison, a second comparator 36 for odd number gradation comparison, an even number gradation counter 37, an odd number gradation counter 38, a frequency half divider 47, a gradation number counter 48 or a strobe signal generator, and a head driver 50. The head driver 50 is disposed fixedly on the thermal head 15. Note that it is possible to dispose the head driver 50 in a manner separate from the thermal head 15.

The frame memory 31 stores image data of one frame input by a digital still camera or other instruments, and in a manner separated into the three colors of yellow, magenta and cyan. The frame memory 31 is controlled by the system controller 26. In the printing operation, image data of one of the three colors to be printed, for example yellow, is read from the frame memory 31 line by line, and written to the line memory 32. Each of one-line image data includes 1024 pixels. The gradation for each pixel is variable in 512 levels from the level 0 to the level 511.

One-line image data stored in the line memory 32 is read by the line memory control circuit 34 driven in synchronism with data transferring clock output by the system controller 26. The one-line image data are sent to both of the first and second comparators 35 and 36.

The frequency half divider 47 divides the data transfer clock generated by the system controller 26, so as to generate divided clock. The gradation number counter 48 as strobe signal generator generates a strobe signal according to the divided clock, and sends the strobe signal to the line memory control circuit 34, the even number gradation counter 37, the odd number gradation counter 38 and the head driver 50.

The even number gradation counter 37 steps the counted value incrementally from 0 by 2 each time that the strobe signal is input, and serially generates the even gradation level data of 0, 2, 4, . . . , 508, 510, and sends the same to the first comparator 35. The odd number gradation counter 38 steps the counted value incrementally from 1 by 2 each time that the strobe signal is input, and serially generates the odd gradation level data of 1, 3, 5, . . . , 509, 511, and sends the same to the second comparator 36.

When the even number gradation counter 37 sends out the gradation level data of level 0, the first comparator 35 compares image data of the pixels in the one line with the gradation level data in a serial manner. A result of the comparison of the one line is sent to the head driver 50 serially as even number gradation heating data in a form of a serial signal. Upon completion of comparing image data of the one line, the even number gradation counter 37 generates the gradation level data of level 2, and sends the same to the first comparator 35. In short, gradation level data of levels 0, 2, 4, . . . , 508, 510 are generated to effect the comparison for 256 times with the image data of each pixel. The image data is converted to the even number gradation heating data of 8 bits. The even number gradation heating data of 8 bits are transferred to the head driver 50 according the transferring process at 256 times.

When the second comparator 36 receives the gradation level data of level 1 from the odd number gradation counter 38, the second comparator 36 compares the image data of each pixel serially with the gradation level data. Results of comparison for the one line are serially sent to the head driver 50 by way of odd number gradation heating data or an odd gradation comparison output in a serial signal form. When the comparison of the one-line image data is completed, the odd number gradation counter 38 generates gradation level data of level 3, and sends the same to the second comparator 36. In short, gradation level data of levels 1, 3, 5, . . . , 509, 511 are generated to effect the comparison for 256 times with the image data of each pixel. The image data is converted to the odd number gradation heating data of 8 bits. The odd number gradation heating data of 8 bits are transferred to the head driver 50 according the transferring process at 256 times.

Thus, the even number gradation heating data are sent to the head driver 50 at the same time as the odd number gradation heating data. If according to the prior art, the gradation heating data for gradation of the 512 levels must be transferred to the head driver 50 in the transferring process at 512 times. However, it is possible in the present invention to transfer the gradation heating data only at 256 times of transfer. This is effective in shortening the time of powering the heating elements. It is to be noted that, when the powering time is shortened, heat energy generated by each heating element becomes lower. Thus, the voltage VH to be applied to the heating elements is predetermined high to compensate for the shortness of the powering time.

Figure 3:
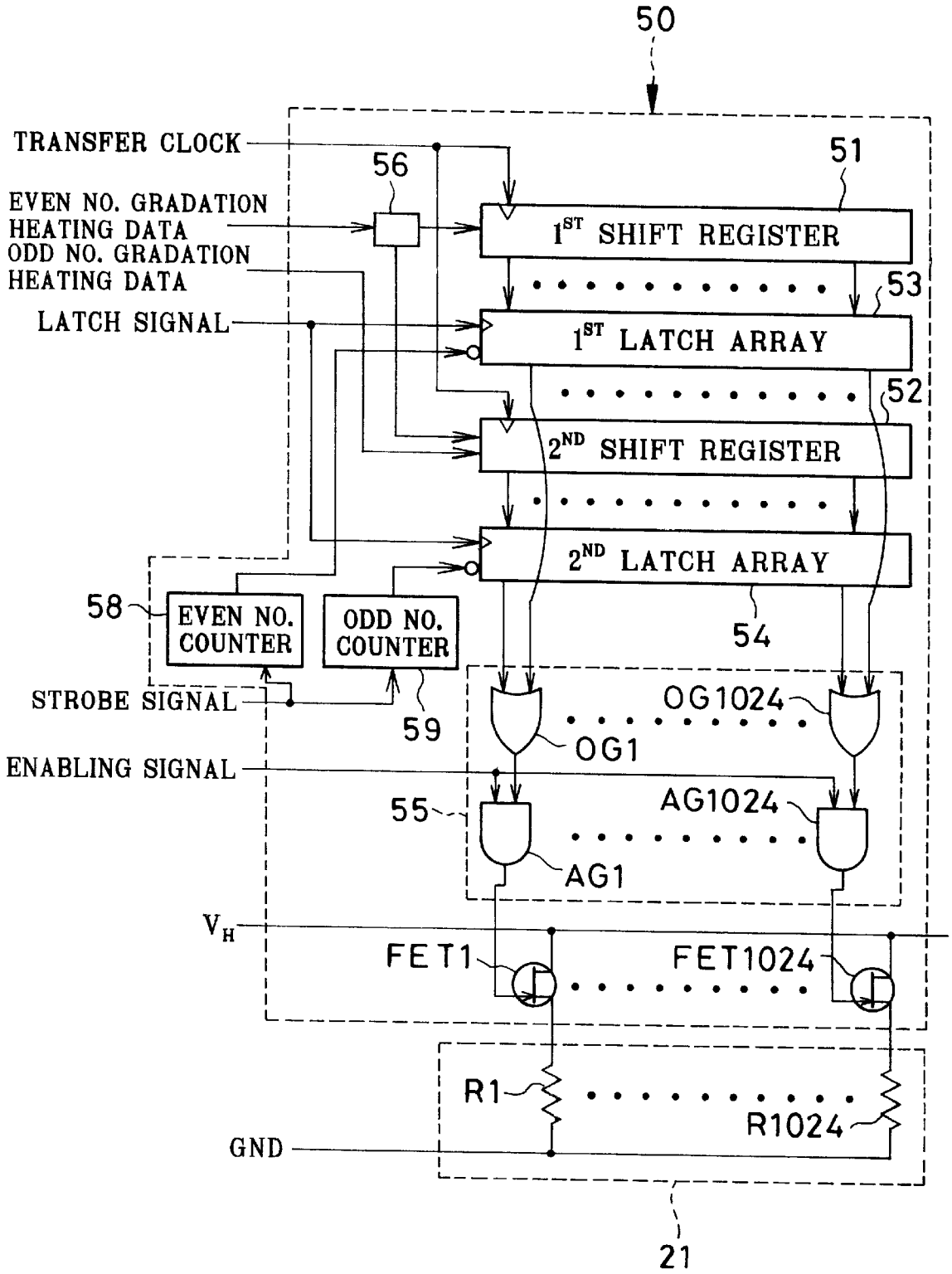
FIG. 3 is block diagram illustrating a head driver in the thermal printer.

In FIG. 3, the head driver 50 is constituted by first and second shift registers 51 and 52, first and second latch arrays 53 and 54, a gate array 55 including OR gates OG1–OG1024, a distributor 56, an even number counter 58 and an odd number counter 59. The above-described even number gradation heating data is input to the first shift register 51. The odd number gradation heating data is input to the second shift register 52. The serial signals of the gradation heating data input to the first and second shift registers 51 and 52 are converted to parallel signals in synchronism with the data transferring clock. At the time of the bias heating, the distributor 56 sends the first and second shift registers 51 and 52 the bias heating data having been obtained by comparison with gradation data of gradation level 0. At the time of gradation heating, the distributor 56 inputs the even number gradation heating data only to the first shift register 51.

The first and second latch arrays 53 and 54 latch gradation heating data in the form of the parallel signals in synchronism with the latch signal. Also, the even number counter 58 is connected to the first latch array 53. The odd number counter 59 is connected to the second latch array 54. The even number counter 58 receives the strobe signal from the gradation number counter 48, incrementally steps the counted value from zero (0) by two upon receipt of the strobe signal, and sends the even counted value to the first latch array 53. The odd number counter 59 incrementally steps the counted value from one (1) by two upon receipt of the strobe signal, and sends the odd counted value to the second latch array 54.

The first and second latch arrays 53 and 54 operate in response to the even and odd counted values from the even and odd number counters 58 and 59, and output the gradation heating data alternately to the gate array 55, the gradation heating data having been latched in the first and second latch arrays 53 and 54. To be precise, gradation heating data of gradation level N is read from the first latch array 53 according to the even counted value from the even number counter 58, where N is an even number. In a manner alternate with this, gradation heating data of gradation level N+1 is read from the second latch array 54 according to the odd counted value from the odd number counter 59.

The gate array 55 is constituted by 1024 OR gates OG1–OG1024 and 1024 AND gates AG1–AG1024 connected to respectively outputs of the OR gates. There are FET1–FET1024, which have a gate connected to each of outputs of the AND gates AG1–AG1024. The FET1–FET1024 have a source with which each of the heating elements R1–R1024 are connected. Also, drains of the FET1–FET1024 are connected to a power source with the voltage VH.

For example, the OR gate OG1 sends the AND gate AG1 a signal of "1". upon receipt of gradation heating data of "1" from the latch array 53 or 54. The OR gate OG1 sends the AND gate AG1 a signal of "0" upon receipt of gradation heating data of "0" from the latch array 53 or 54. While the AND gate AG1 receives the strobe signal, the AND gate AG1 sends a signal of 1 to the FET1 if the OR gate OG1 outputs the signal of 1, and sends a signal of 0 to the FET1 if the OR gate OG1 outputs the signal of 0. The FET1 is turned on if the OR gate OG1 outputs the signal of 1, and is turned off if the OR gate OG1 outputs the signal of 0. When the FET1 is turned on, a current from the power source flows through the heating element R1 at the voltage VH, to drive the heating element R1 to generate heat. In a manner similar to this, the remaining elements operate, including the OR gates OG2–OG1024, the AND gates AG2–AG1024, the FET2–FET1024 and the heating elements R2–R1024.

Figure 4A:
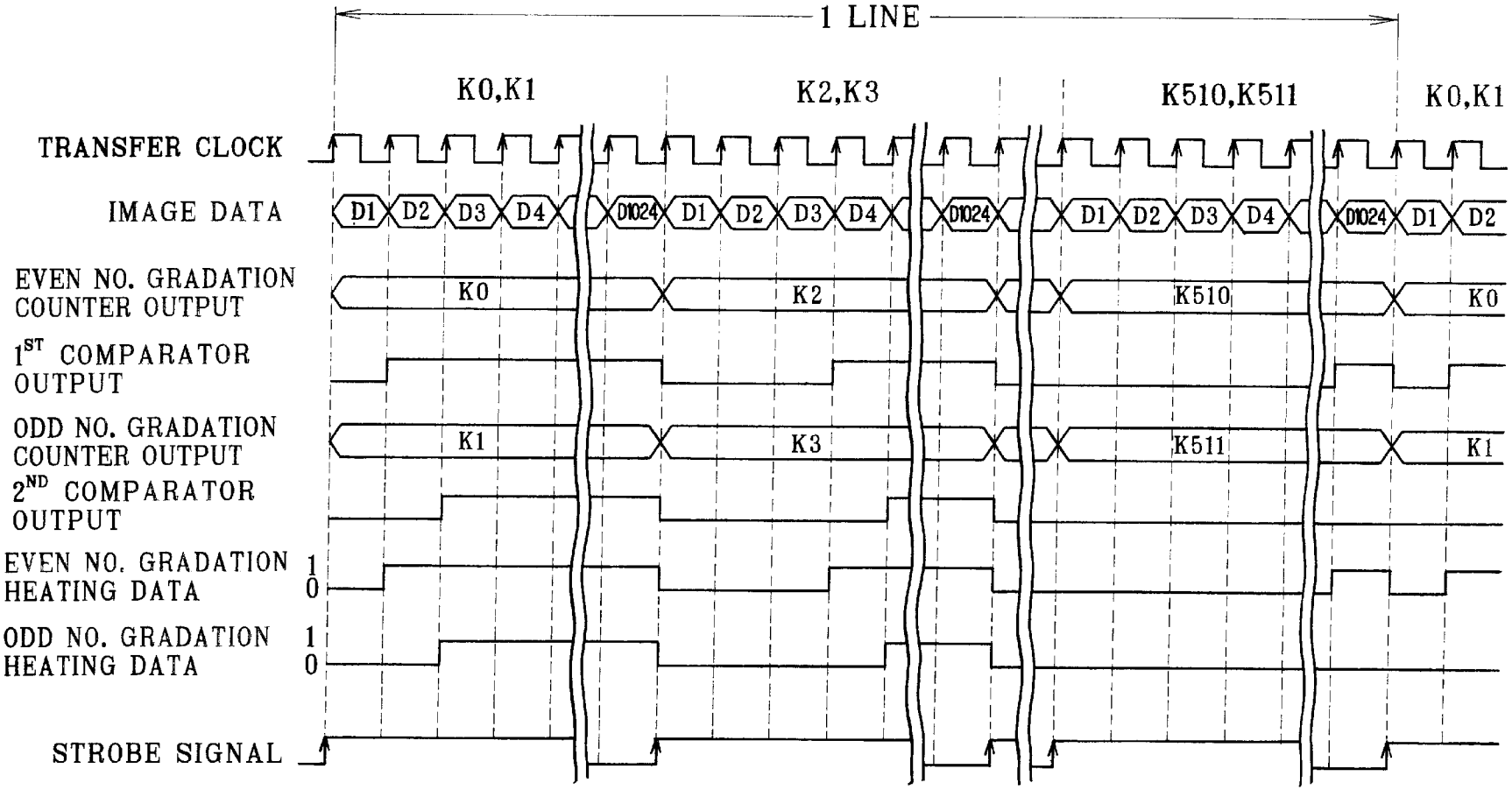
FIGS. 4A and 4B are timing charts illustrating operation of creating even and odd number gradation heating data to be transferred to the head driver.
Figure 4B:
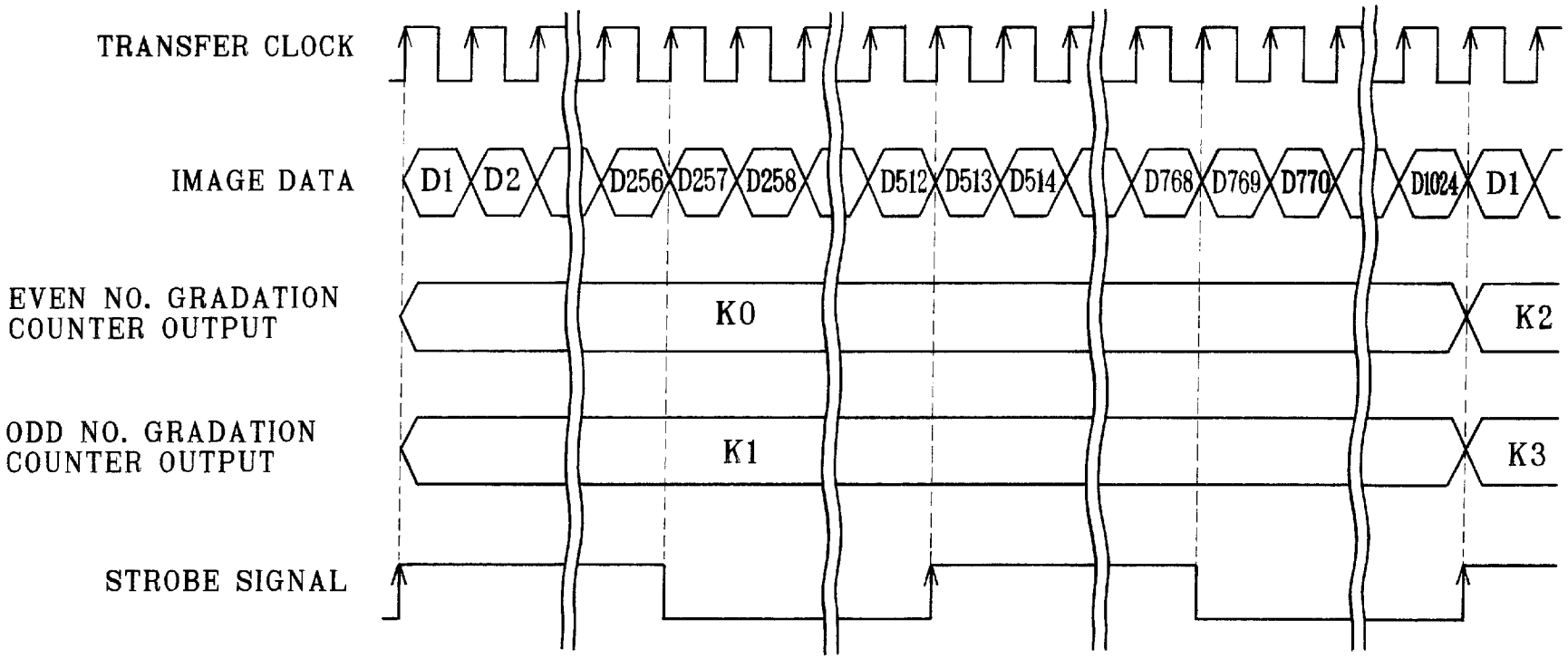
Figure 5:
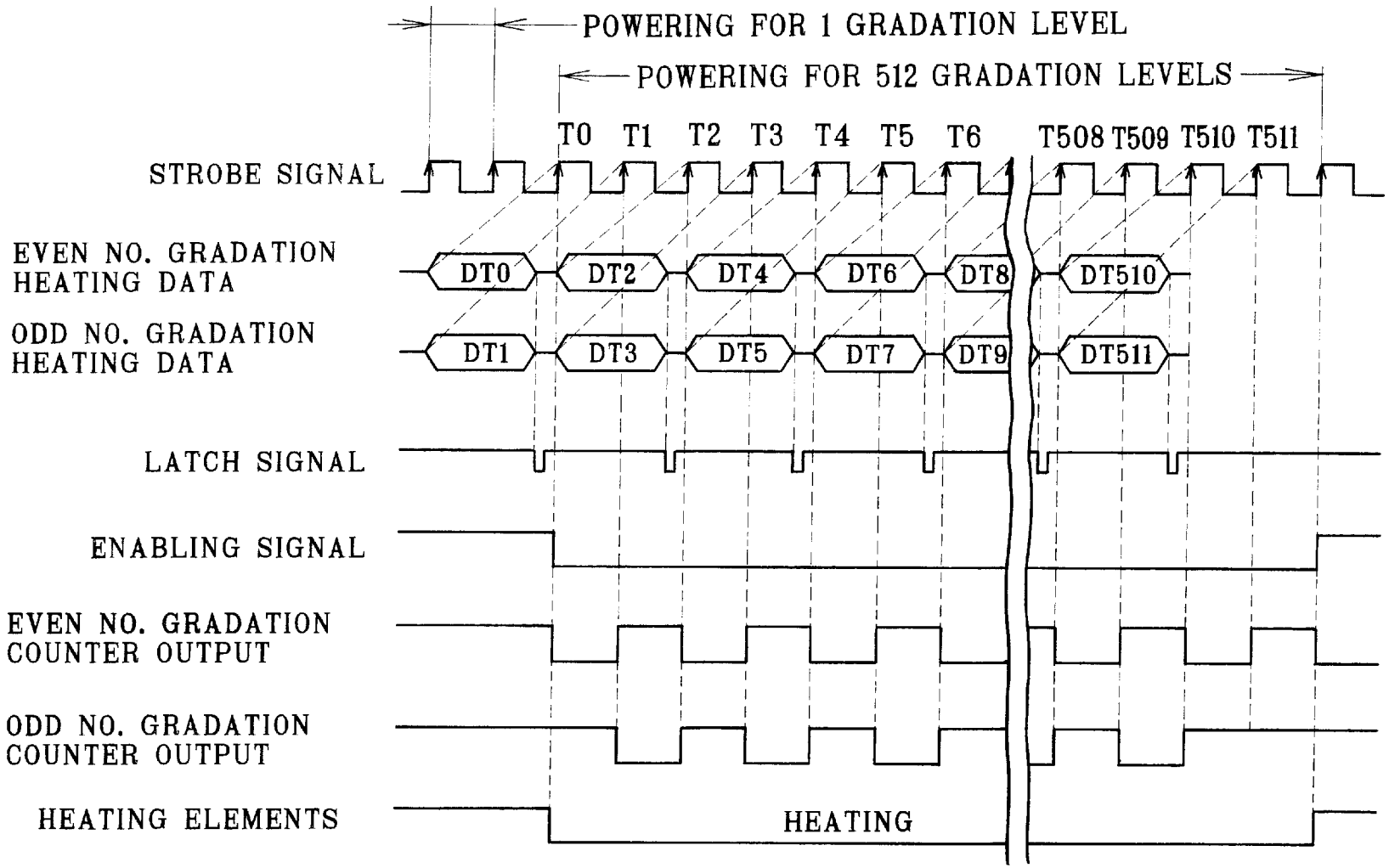
FIG. 5 is a timing chart illustrating operation of the head driver.

The operation of the thermal printer is described now with reference to FIGS. 4A, 4B and 5. At first, an image to be printed is chosen. Three color image data are written to the frame memory 31. When a printing key is operated, the recording material 10 is drawn from the recording material roll 10*a* by the feeder roller set 11. A front edge of the recording material 10 is nipped by the capstan roller 12 and the nip roller 13. The capstan roller 12 is driven by the stepping motor 28 and feeds the recording material 10 in the printing direction α.

When an edge of the recording region of the recording material 10 reaches the thermal head 15, thermal recording is started. At first, one-line yellow image data is read from the frame memory 31 and is once written to the line memory 32. For effecting the bias heating to the yellow coloring layer in the recording material 10, the image data is read from the line memory 32 serially pixel after pixel, sent to the first comparator 35 and compared with the gradation level data of level "0". For pixels to record yellow, the first comparator 35 outputs a signal of 1. For pixels without recording yellow, the first comparator 35 outputs a signal of 0. Results of the comparison for the pixels are sent to the head driver 50 as bias heating data.

The bias heating data are sent by the distributor 56 in the head driver 50 to the first and second shift registers 51 and 52, shifted in the first and second shift registers 51 and 52 by the data transfer clock, and converted to bias heating data in the parallel form. The bias heating data are then latched by the first and second latch arrays 53 and 54, are read alternately from the first and second latch arrays 53 and 54 according to the even counted value from the even number counter 58 and the odd counted value from the odd number counter 59, and are input to the gate array 55.

The system controller 26 generates a yellow bias heating pulse, of which a width is great enough for the yellow coloring layer in the recording material 10, and sends the pulse to the AND gates AG1–AG1024 by way of an enabling signal. The AND gates AG1–AG1024 output a logical product of the enabling signal and outputs of the OR gates OG1–OG1024. If a certain one of the OR gates OG1–OG1024 outputs a signal of 1, one of the AND gates AG1–AG1024 associated with the certain OR gate outputs a signal of 1.

For example, the OR gate OG1 outputs a signal of 1. Then the AND gate AG1 also outputs a signal of 1, so as to turn on the FET1. The heating element R1 is powered to generate heat. Operation of the heating element R1 continues during time according to the bias heating pulse. Bias heat energy predetermined for yellow recording is applied to the recording material 10.

Before completion of the bias heating, the first comparator 35 compares image data of the pixels serially with the gradation level data of level 0 generated by the even number gradation counter 37. Results of the comparison are sent to the first shift register 51 in the head driver 50 as even number gradation heating data in a serial form. In a manner simultaneous with this, the second comparator 36 compares image data of the pixels serially with the gradation level data of level 1 generated by the odd number gradation counter 38. Results of the comparison are sent to the second shift register 52 in the head driver 50 as odd number gradation heating data in a serial form. Similarly, one-line image data read by the first comparator 35 is compared serially with the gradation level data of levels 2, 4, . . . , 508, 510. Simultaneously, one-line image data read by the second comparator 36 is compared serially with the gradation level data of levels 3, 5, . . . , 509, 511. Then the even and odd number gradation heating data obtained by the comparison are sent to the first and second shift registers 51 and 52 in the head driver 50. See FIGS. 4A and 4B.

Accordingly, the image data for the 512 levels of gradation is transferred to the head driver 50 at 256 times of the transfer. The time required for the transfer of the gradation heating data is shortened to the value half as long as that according to the prior art. FIGS. 4A and 4B are timing charts for an example in which image data D1, D2, D3, . . . , D1023, D1024 for one line are such having gradation levels 1, 2, . . . , 511, 512, 1, 2, . . . , 511, 512 in the sequence of the pixels. In FIGS. 4A and 4B, K0, K1, K2, . . . , K510, K511 represent gradation levels expressed actually according the binary or hexadecimal notation, and are gradation levels 0, 1, 2, . . . , 510, 511 if expressed in the decimal notation.

When the bias heating is completed, the system controller 26 generates a gradation heating pulse having a width changeable in a range of 511 gradation levels with which density of a pixel can be maximized. The gradation heating pulse is sent to the AND gates AG1–AG1024 as an enabling signal.

The gradation heating data converted to the parallel form by the first and second shift registers 51 and 52 are latched by the first and second latch arrays 53 and 54 in synchronism with the latch signal. Then the gradation heating data are read from the first and second latch arrays 53 and 54 alternately by following the even counted value from the even number counter 58 and the odd counted value from the odd number counter 59, and are input to the gate array 55. Assuming that the gradation level of each pixel is between the lowest and highest or between 0 and 511, OR gates OG1–OG1024 are supplied with a certain number of signals of 1 and then a certain number of signals of 0 consecutively. For example, if the gradation level of a pixel is level 100, an OR gate is consecutively supplied with 100 signals of 1 and then 411 signals of 0.

When a certain one of the OR gates OG1–OG1024 outputs a signal of 1, the one of the AND gates AG1–AG1024 associated with the certain OR gate outputs a signal of 1. When a certain one of the AND gates AG1–AG1024 outputs the signal of 1, the one of the FET1–FET1024 associated with the certain AND gate is turned on, to power an associated heating element.

The enabling signal is a gradation expressing pulse having a length according to the level 511 as highest gradation level. Time during which the OR gate OG1 is supplied with consecutive signals of 1 is time for powering the heating element R1. See FIG. 5. Once the OR gate OG1 is supplied with a signal of 0, powering the heating element R1 is discontinued. Thus, the yellow coloring layer is colored at density for the intended gradation levels for the pixels. Note that FIG. 5 is a timing chart for a state in which a heating element is driven for the highest density at level 511.

Upon completion of recording the yellow first line, the stepping motor 28 rotates the capstan roller 12 in a stepwise manner, to feed the recording material 10 in the printing direction at an amount of one line. At the same time, one-line image data for a yellow second line is read from the frame memory 31. According to the image data, the second line is recorded to the recording material 10 thermally.

When the portion with the yellow image recorded therein comes to a position under the yellow fixer lamp 23, the yellow fixer lamp 23 applies visible violet rays with a wavelength peaking at approximately 420 nm, and fixes the yellow coloring layer.

When the yellow recording and fixation are completed, the capstan roller 12 comes to rotate backwards, to feed the recording material 10 in the reverse direction β. The recording material roll 10*a* also rotates backwards to wind back the recording material 10. Note that it is possible not to rotate the recording material roll 10*a* backwards, but to loop the recording material 10 in a space between the feeder roller set 11 and the capstan roller 12.

The recording material 10 is fed in the reverse direction β, so as to cause a front edge of a recording region to reach the thermal head 15. Then rotation of the capstan roller 12 is changed over to the forward direction. The recording material 10 is fed stepwise by one pixel in the printing direction α for recording a magenta image line after line in a manner similar to the yellow recording.

The bias heat energy required for the magenta recording is higher than that required for the yellow recording. At the start of recording each line, a magenta bias heating pulse is sent from the system controller 26 to the AND gates AG1–AG1024 as enabling signal, the magenta bias heating pulse having a greater width than a yellow bias heating pulse. After the bias heating, gradation heating is effected in a similar manner as that in the yellow recording.

When the recording region with the magenta image recorded therein comes to a position under the magenta fixer lamp 24, the magenta fixer lamp 24 applies ultraviolet rays with a wavelength peaking at approximately 365 nm, and fixes the magenta coloring layer. After this, the recording material roll 10*a* and the capstan roller 12 are rotated backwards, to wind back the recording material 10 again.

When the front edge of the recording region of the recording material 10 returns to the thermal head 15, rotation of the recording material roll 10*a* and the capstan roller 12 changes over to the printing direction. The recording material 10 is fed in the printing direction stepwise pixel by pixel, to record a cyan image to the cyan coloring layer line after line.

The bias heat energy required for the cyan recording is higher than that required for the magenta recording. At the start of recording each line, a cyan bias heating pulse is sent from the system controller 26 to the AND gates AG1–AG1024 as enabling signal, the cyan bias heating pulse having a greater width than the magenta bias heating pulse. After the bias heating, gradation heating is effected in a similar manner as that in the yellow or magenta recording.

After the cyan recording, the cutter 25 is actuated to cut the image recorded portion of the recording material 10 from the recording material roll 10*a*. The recording material 10 being cut is fed continuously in the printing direction α, and ejected from the thermal printer. There is no fixability in the cyan coloring layer. The yellow and magenta fixer lamps 23 and 24 are supplied with no power and do not operate.

In the above embodiment, the image data is compared by use of gradation level data of even and odd numbers. The even and odd gradation heating data are simultaneously transferred to the head driver. Furthermore, the gradation level data may be grouped into three or more groups. Gradation heating data of three or more kinds can be simultaneously transferred to the head driver, so that the transferring time can be shortened in a further manner. In such a construction, three or more transferring lines are connected between the head driver and comparators. The head driver have shift registers and latch arrays of the same number as the groups of the gradation level data.

Figure 6:
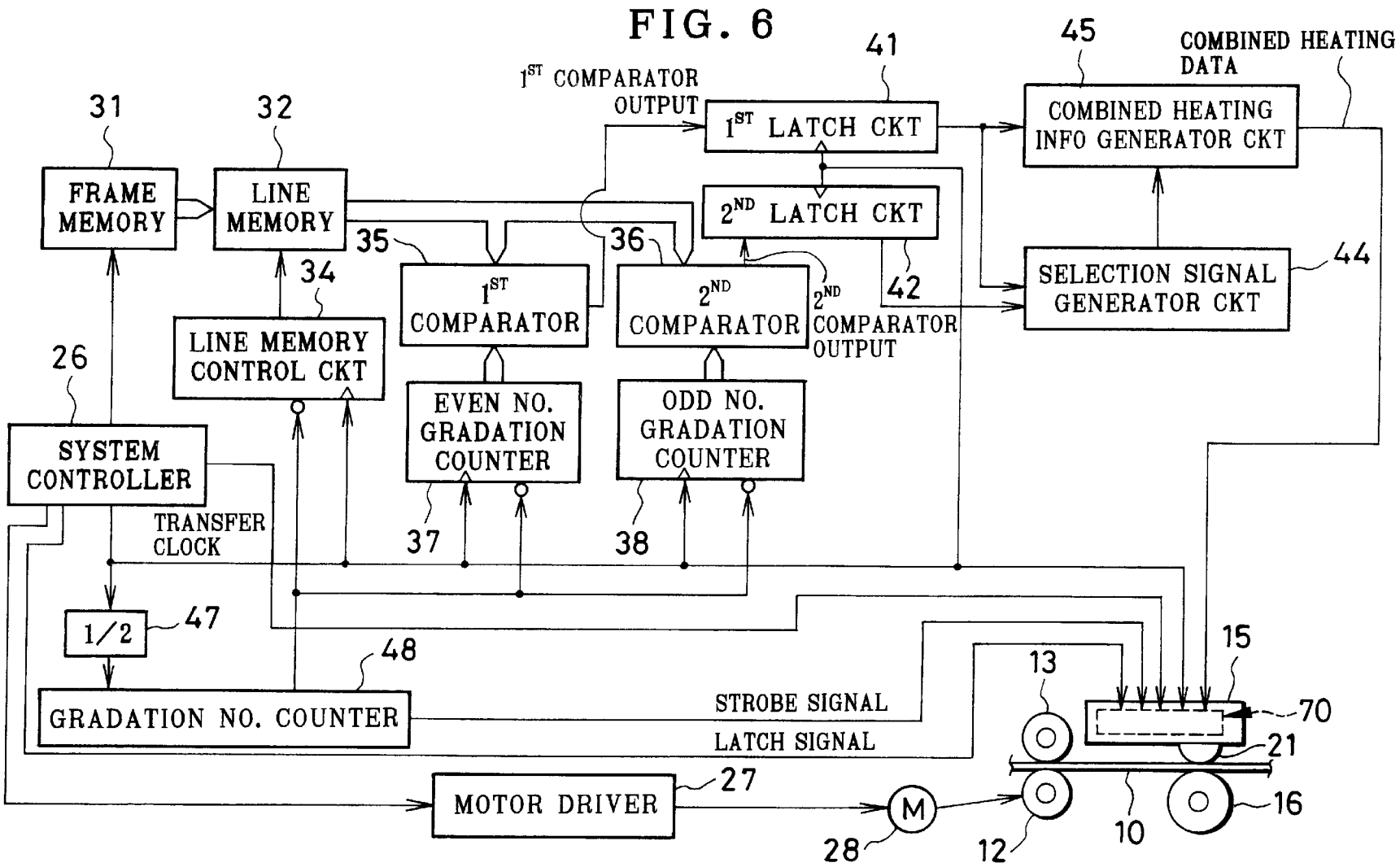
FIG. 6 is a block diagram illustrating another preferred thermal printer with one line through which the gradation heating data is transferred to a head driver.

In FIGS. 6–9, another preferred embodiment is illustrated, in which only one transferring line is used. Elements similar to those of the above embodiment are designated with identical reference numerals. In FIG. 6, the circuits in the thermal printer includes a first latch circuit 41, which receives 8-bit even number gradation comparison output from the first comparator 35 in the transferring processes of 256 times. A second latch circuit 42 receives 8-bit odd number gradation comparison output from the second comparator 36 in the transferring processes of 256 times.

A selection signal generator circuit 44 is connected with the first and second latch circuits 41 and 42. If the same value is latched by the first and second latch circuits 41 and 42, the selection signal generator circuit 44 generates a signal of 0. If different values are latched by the first and second latch circuits 41 and 42, the selection signal generator circuit 44 generates a signal of 1. A combined heating information generator circuit 45 is supplied with the selection signal of either 0 or 1 by the selection signal generator circuit 44.

If the selection signal generator circuit 44 outputs the selection signal of "0", then the combined heating information generator circuit 45 outputs the gradation heating data in the through output manner, namely outputs a signal of 0 or 1 as even number gradation comparison output latched by the first latch circuit 41 without a change. If the selection signal generator circuit 44 outputs the section signal of "1", then the combined heating information generator circuit 45 outputs the gradation heating data of "−1". Thus, the combined heating information generator circuit 45 sends a head driver 70 the three-value gradation heating data of 0, 1 and −1. It is to be noted that the signal "−1" is a flag. When the signal "−1" is generated, driving time during which each heating element is driven is half as long as that upon generation of the signal "1". Furthermore, the combined heating information generator circuit 45 may be a biphase mark selection circuit constituted by an analog multiplexer circuit. In such a construction, signals of voltages 0 V, +5 V and −5 V are used for respectively the gradation heating data 0, 1 and −1.

Figure 7:
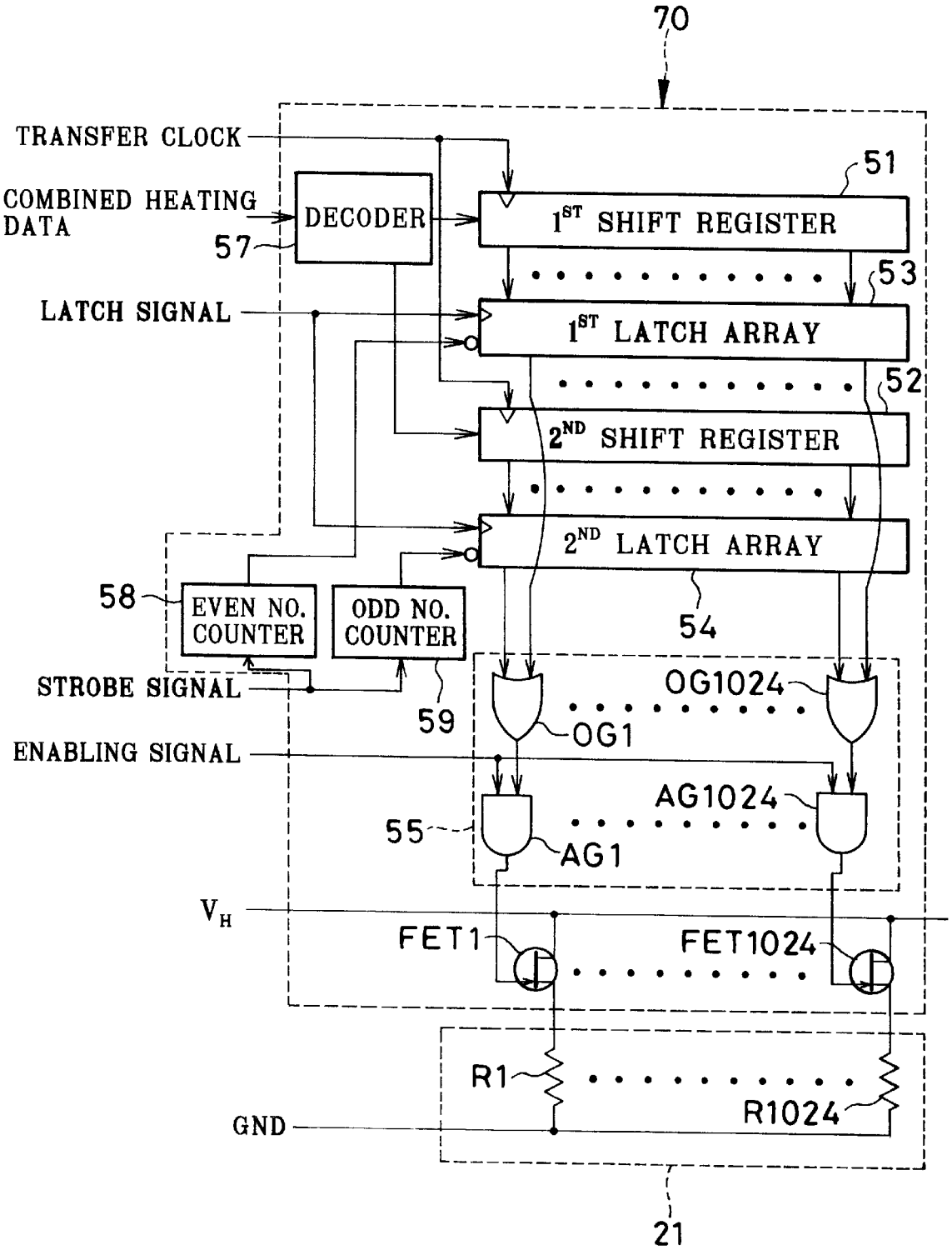
FIG. 7 is a block diagram illustrating operation of the head driver.

In FIG. 7, a construction of the head driver 70 is depicted. A decoder 57 is supplied with the three-value gradation heating data from the combined heating information generator circuit 45. The decoder 57, if supplied with gradation heating data of 0, sends data of "0" to the first and second shift registers 51 and 52, and if supplied with gradation heating data of "1", sends data of 1 to the first and second shift registers 51 and 52. If the decoder 57 is supplied with gradation heating data of "−1", the decoder 57 sends data of 1 to the first shift register 51 and data of 0 to the second shift register 52. The gradation heating data of the serial form in the first and second shift registers 51 and 52 are converted to the parallel signals in synchronism with the data transferring clock.

The first and second latch arrays 53 and 54 respond to a latch signal, and latch the gradation heating data converted to the parallel form by the first and second shift registers 51 and 52. The even number counter 58 is connected with the first latch array 53. The odd number counter 59 is connected with the second latch array 54. The even number counter 58 sends the even counted value to the first latch array 53, the even counted value being stepped up by two from zero (0) upon the strobe signal output by the gradation number counter 48. The odd number counter 59 sends the odd counted value to the second latch array 54, the odd counted value being stepped up by two from one (1).

The first and second latch arrays 53 and 54 are supplied with even and odd counted values from the even and odd number counters 58 and 59, and in response to these, outputs the latched gradation heating data to the gate array 55 alternately. To be precise, the gradation heating data of the gradation level N is read from the first latch array 53 according to the even counted value of the even number counter 58, and the gradation heating data of the gradation level N+1 is read from the second latch array 54 according to the odd counted value of the odd number counter 59, where N is an even number equal to or more than zero (0). The gradation heating data being read out alternately are sent to the gate array 55.

Figure 8:
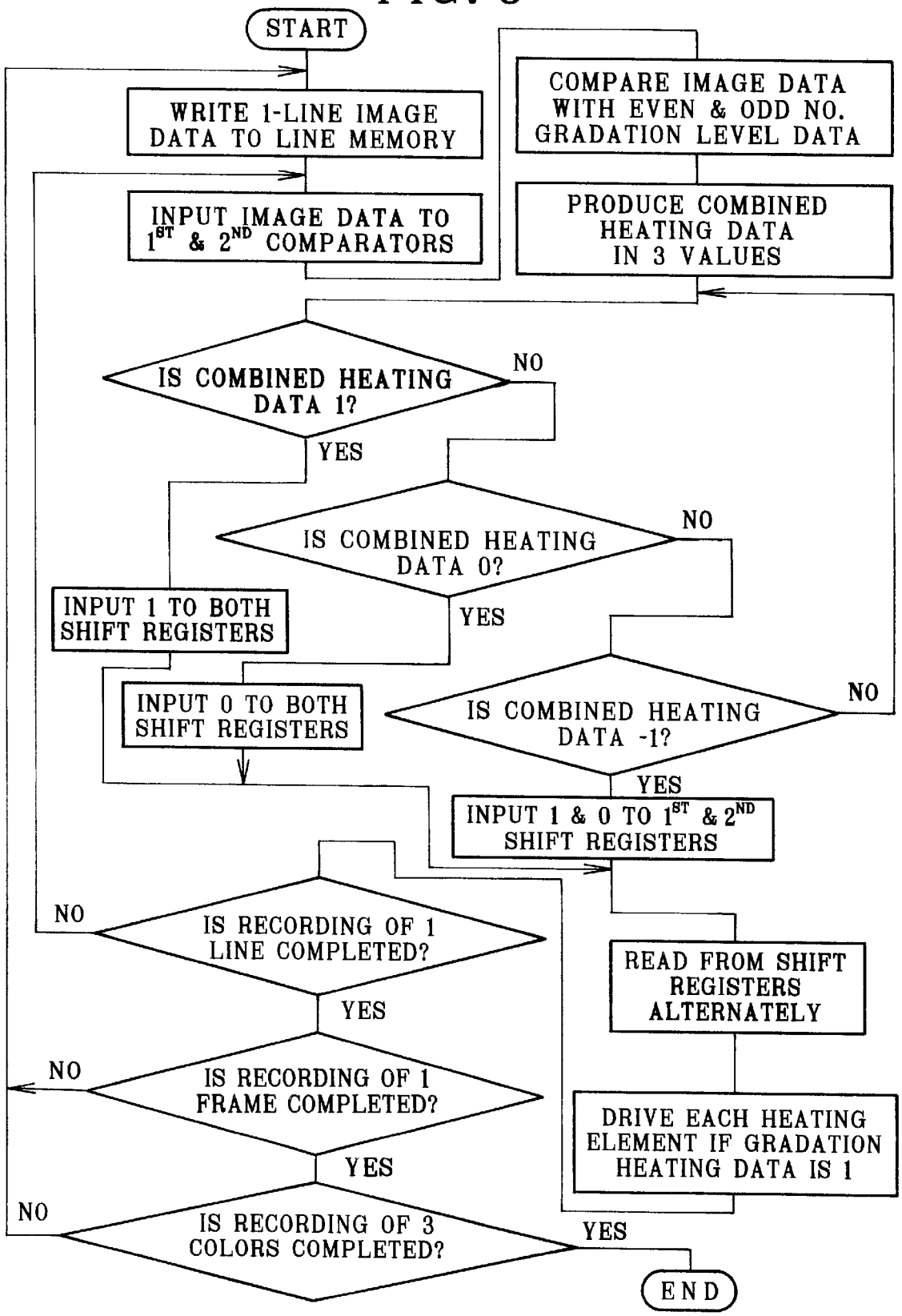
FIG. 8 is a flow chart illustrating operation of the thermal printer.
Figure 9:
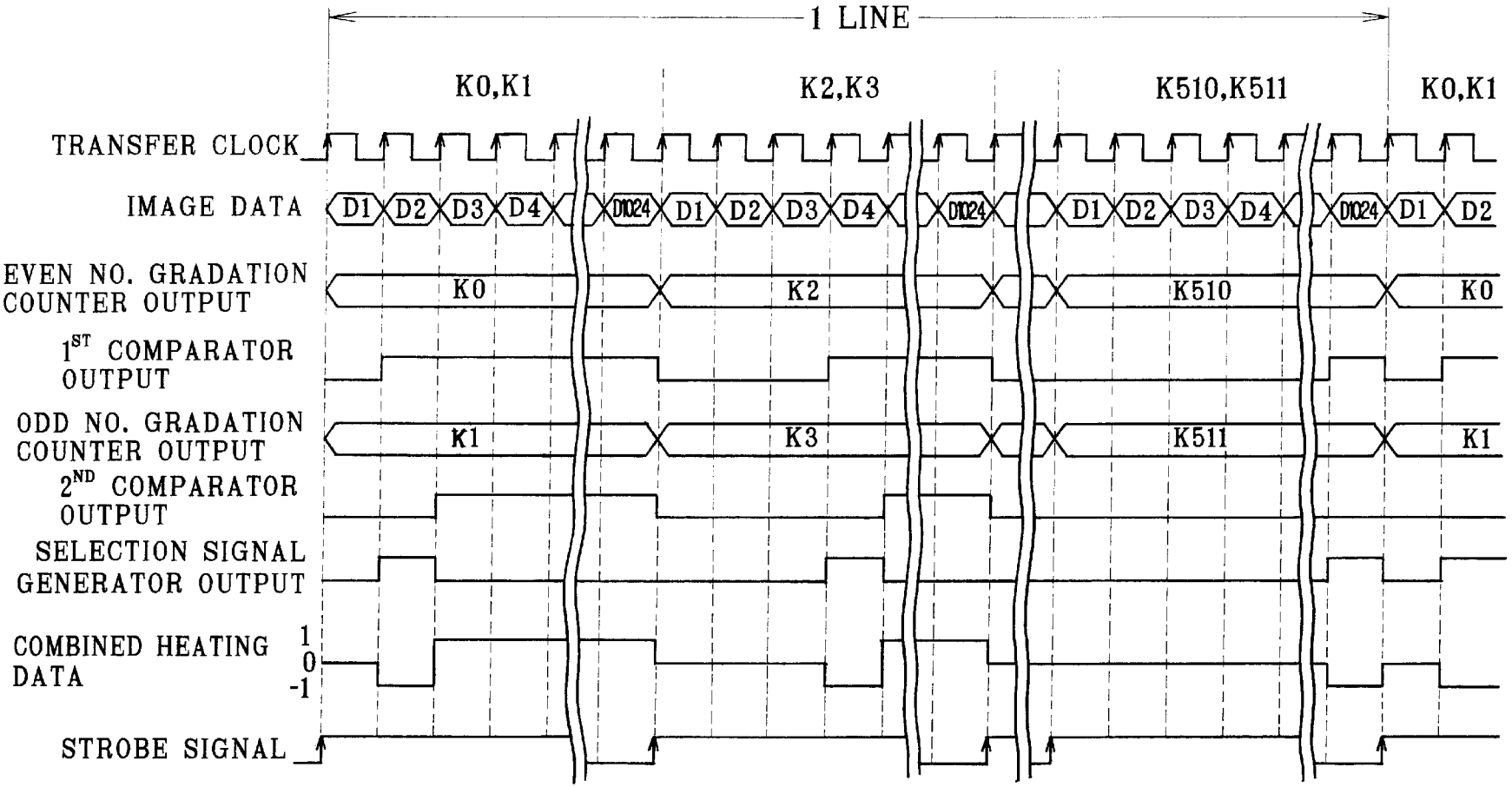
FIG. 9 is a timing chart illustrating operation of creating combined heating data to be transferred to the head driver.

The operation of the thermal printer is described now with reference to FIGS. 8 and 9. For bias heating to the yellow coloring layer in the recording material 10, image data for pixels are read from the line memory 32, sent only to the first comparator 35, and compared with gradation level data of gradation level 0. For pixels to develop yellow, the first comparator 35 outputs a signal of 1. For pixels without color recording, the first comparator 35 outputs a signal of 0. Results of the comparison of pixels are latched by the first latch circuit 41, output from the combined heating information generator circuit 45 in the through output manner, and sent to the head driver 70 as the bias heating data in the serial form.

The bias heating data is sent to the decoder 57 in the head driver 70, and then sent to the first and second shift registers 51 and 52, shifted in the first and second shift registers 51 and 52 in response to the data transferring clock, and converted to the bias heating data in a parallel form. The bias heating is effected according to the sequence the same as that of the above embodiment.

Before the completion of the bias heating, the first comparator 35 operates again for serial comparison of the image data of pixels with the gradation level data of level 0 output by the even number gradation counter 37. Results of the comparison are sent to the first latch circuit 41 as even number gradation comparison output in the serial form. At the same time, the second comparator 36 serially compares the image data of pixels with the gradation level data of level 1 output by the odd number gradation counter 38. Results of the comparison are sent to the second latch circuit 42 as odd number gradation comparison output in the serial signal form. Similarly, the one-line image data read by the first comparator 35 is compared with the gradation level data of levels 2, 4, . . . , 508, 510. Simultaneously, the one-line image data read by the second comparator 36 is compared with the gradation level data of levels 3, 5, . . . , 509, 511. Results of the comparison are sent to the first and second latch circuits 41 and 42.

The selection signal generator circuit 44 compares the even and odd number gradation comparison outputs simultaneously latched by the first and second latch circuits 41 and 42. The selection signal generator circuit 44, if those are equal to each other, sends the selection signal of 0 to the combined heating information generator circuit 45, and if those are different from each other, sends the selection signal of 1 to the combined heating information generator circuit 45. The combined heating information generator circuit 45, upon receiving the selection signal of 0, sends the even number gradation comparison output of 1 or 0 from the first latch circuit 41 to the head driver 70 without a change by way of gradation heating data. The combined heating information generator circuit 45, upon receiving the selection signal of 1, sends gradation heating data of −1 to the head driver 70. See FIG. 9. Thus, image data of the 512 gradation levels can be sent to the head driver 70 by transferring sequence at 256 times. The time required for the transfer is shortened to half as long as that according to the prior art.

The decoder 57 discerns which the gradation heating data received by the head driver 70 is of 1, 0 and −1. If the gradation heating data is 1, then a signal of 1 is input to both of the first and second shift registers 51 and 52. If the gradation heating data is 0, then a signal of 0 is input to both of the first and second shift registers 51 and 52. If the gradation heating data is −1, then a signal of 1 is input to the first shift register 51, a signal of 0 being input to the second shift register 52. After this, the head driver 70 operates in the same sequence as the above embodiment.

In the above embodiments, the even and odd number gradation counters 37 and 38 step the gradation level by two incrementally upon generation of two strobe signals. However, the period of the strobe signal may be predetermined suitably. The even and odd number gradation counters 37 and 38 step the gradation level by two incrementally upon generation of one strobe signal, or three or more strobe signals.

In the above embodiments, the gradation levels for each pixel are the 512 levels from level 0 to level 511. However, the predetermined step range of the gradation in the present invention may have a lowest level not being level 0, and may have a highest level not being level 511. Also, the gradation levels in the present invention can be the 256 levels in a manner similar to a conventional thermal printer. This makes printing possible at such a high speed that the printing time can be reduced to half as long as the prior art.

The combined heating information generator circuit 45 may be the above-described biphase mark selection circuit, but also may be an FSK (frequency shift keying) modulation multiplex circuit which modulates the carrier wave digitally. If the combined heating information generator circuit 45 is the biphase mark selection circuit, the decoder 57 may be a window comparator. If the combined heating information generator circuit 45 is the FSK modulation multiplex circuit, then the decoder 57 may be an FSK (frequency shift keying) demodulation circuit.

In the above embodiment, the thermal printer is a line printer in which the heating element array is oriented in the main scan direction and the recording sheet is fed in the sub scan direction. Also, the thermal printer may be a serial printer in which the heating element array is oriented in the main scan direction and moved in the sub scan direction, and the recording sheet is fed in the main scan direction. In the above embodiment, the recording material is the color thermosensitive recording sheet. Also, the thermal recording in the present invention may be thermal transfer recording in which a thermal head applies heat to ink film and transfers ink to recording sheet. An example of the thermal transfer recording is sublimation thermal recording.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A thermal printing method, in which a head driver drives respectively plural heating elements arranged in a heating element array included in a thermal head, and said heating elements generate heat energy according to heating data for recording to thermosensitive recording material by one line, said thermal printing method comprising steps of:

outputting gradation level data of gradation level 2n in an even number sequence one after another in a manner serially changing said gradation level, where n is an integer equal to or more than zero;

outputting gradation level data of gradation level 2n+1 in an odd number sequence one after another in a manner serially changing said gradation level, wherein said gradation level data of said odd number sequence are output substantially simultaneously with said gradation level data of said even number sequence according to respective values of n;

serially comparing one-line image data for plural pixels in said one line with said gradation level data of said even number sequence, so as to create even number gradation heating data in a serial signal form;

serially comparing said one-line image data with said gradation level data of said odd number sequence, so as to create odd number gradation heating data in a serial signal form;

transferring said even and odd number gradation heating data of said one line to said head driver in parallel with each other upon being created substantially simultaneously;

after transfer to said head driver, converting said even number gradation heating data being serial for said one line into a parallel signal form;

after transfer to said head driver, converting said odd number gradation heating data being serial for said one line into a parallel signal form; and driving respectively said heating elements for recording by two gradation levels by alternately retrieving said even and odd number gradation heating data of said one line.

2. A thermal printing method as defined in claim 1, wherein said gradation level data are output one after another in a manner increasing said gradation levels.

3. A thermal printing method as defined in claim 2, wherein said even and odd number gradation heating data are converted into said parallel signal form by even and odd shift registers.

4. A thermal printing method as defined in claim 3, wherein in said driving step, outputs from said even shift register are latched by a first latch array, outputs from said odd shift register are latched by a second latch array, said first and second latch arrays are alternately allowed for latching operation for alternately retrieving said even and odd number gradation heating data.

5. A thermal printing method, in which a head driver drives respectively plural heating elements arranged in a heating element array included in a thermal head, and said heating elements generate heat energy according to heating data for recording to thermosensitive recording material by one line, said thermal printing method comprising steps of:

outputting gradation level data of gradation level 2n in an even number sequence one after another in a manner serially changing said gradation level, where n is an integer equal to or more than zero;

outputting gradation level data of gradation level 2n+1 in an odd number sequence one after another in a manner serially changing said gradation level, wherein said gradation level data of said odd number sequence are output substantially simultaneously with said gradation level data of said even number sequence according to respective values of n;

serially comparing one-line image data for plural pixels in said one line with said gradation level data of said even number sequence, so as to create even number gradation heating data in a serial signal form;

serially comparing said one-line image data with said gradation level data of said odd number sequence, so as to create odd number gradation heating data in a serial signal form;

creating combined heating data in a serial signal form according to a substantially simultaneously created combination of said even and odd gradation heating data, said combined heating data being any one of first, second and third information different from one another;

transferring said combined heating data to said head driver upon being created sequentially;

after transfer of said combined heating data to said head driver, converting said combined heating data into even and odd gradation heating data;

converting said even number gradation heating data being serial for said one line into a parallel signal form;

converting said odd number gradation heating data being serial for said one line into a parallel signal form; and driving respectively said heating elements for recording by two gradation levels by alternately retrieving said even and odd number gradation heating data of said one line.

6. A thermal printing method as defined in claim 5, wherein said combination of said even and odd gradation heating data is any one of 00, 01 and 11, and said combined heating data is said first information if said combination is 00, is said second information if said combination is 01, and is said third information if said combination is 11.

7. A thermal printing method as defined in claim 6, wherein said first information is 0, said second information is −1, and said third information is 1.

8. A thermal printing method as defined in claim 6, wherein said gradation level data are output one after another in a manner increasing said gradation levels.

9. A thermal printing method as defined in claim 8, wherein said even and odd number gradation heating data are converted into said parallel signal form by even and odd shift registers.

10. A thermal printing method as defined in claim 9, wherein in said driving step, outputs from said even shift register are latched by a first latch array, outputs from said odd shift register are latched by a second latch array, said first and second latch arrays are alternately allowed for latching operation for alternately retrieving said even and odd number gradation heating data.

11. A thermal printer, having a thermal head including a heating element array in which plural heating elements are arranged, and a head driver for driving respectively said heating elements, wherein said heating elements generate heat energy according to heating data for recording to thermosensitive recording material by one line, said thermal printer comprising:

a line memory for storing one-line image data;

an even number gradation counter for outputting gradation level data of gradation level 2n in an even number sequence one after another at each time of counting of a clock, where n is an integer equal to or more than zero;

an odd number gradation counter for outputting gradation level data of gradation level 2n+1 in an odd number sequence one after another at each time of said clock counting, wherein said gradation level data of said odd number sequence are output substantially simultaneously with said gradation level data of said even number sequence according to respective values of n;

a first comparator for serially comparing said one-line image data with said gradation level data from said even number gradation counter, so as to create even number gradation heating data in a serial signal form;

a second comparator for serially comparing said one-line image data with said gradation level data from said odd number gradation counter, so as to create odd number gradation heating data in a serial signal form;

said head driver including:

(A) a first shift register for converting said even number gradation heating data of said one line into a parallel signal form;

(B) a second shift register for converting said odd number gradation heating data of said one line into a parallel signal form; and (C) a drive signal generator for generating a drive signal to drive respectively said heating elements by two gradation levels by alternately retrieving said even and odd number gradation heating data of said one line from said first and second shift registers.

12. A thermal printer as defined in claim 11, wherein said drive signal generator includes:

a strobe signal generator for generating a strobe signal at a period of powering for each one of said gradation levels;

an even number counter for generating an even count signal if a strobe signal number of strobe signals is even;

a first latch array, connected with said first shift register, for latching said even number gradation heating data in response to said even count signal;

an odd number counter for generating an odd count signal if said strobe signal number is odd;

a second latch array, connected with said second shift register, for latching said odd number gradation heating data in response to said odd count signal;

an OR gate array, supplied with said even and odd number gradation heating data by said first and second latch arrays, for outputting said drive signal.

13. A thermal printer, having a thermal head including a heating element array in which plural heating elements are arranged, and a head driver for driving respectively said heating elements, wherein said heating elements generate heat energy according to heating data for recording to thermosensitive recording material by one line, said thermal printer comprising:

a line memory for storing one-line image data;

an even number gradation counter for outputting gradation level data of gradation level 2n in an even number sequence one after another at each time of counting of a clock, where n is an integer equal to or more than zero;

an odd number gradation counter for outputting gradation level data of gradation level 2n+1 in an odd number sequence one after another at each time of said clock counting, wherein said gradation level data of said odd number sequence are output substantially simultaneously with said gradation level data of said even number sequence according to respective values of n;

a first comparator for serially comparing said one-line image data with said gradation level data from said even number gradation counter, so as to create even number gradation heating data in a serial signal form;

a second comparator for serially comparing said one-line image data with said gradation level data from said odd number gradation counter, so as to create odd number gradation heating data in a serial signal form;

a combined heating data generator for creating combined heating data in a serial signal form according to a substantially simultaneously created combination of said even and odd gradation heating data, and for transferring said combined heating data to said head driver upon being created sequentially, said combined heating data being any one of first, second and third information different from one another;

said head driver including:

(A) a decoder for converting said combined heating data into even and odd gradation heating data;

(B) a first shift register for converting said even number gradation heating data of said one line into a parallel signal form;

(C) a second shift register for converting said odd number gradation heating data of said one line into a parallel signal form; and (D) a drive signal generator for generating a drive signal to drive respectively said heating elements by two gradation levels by alternately retrieving said even and odd number gradation heating data of said one line from said first and second shift registers.

14. A thermal printer as defined in claim 13, wherein said combination of said even and odd gradation heating data is any one of 00, 01 and 11, and said combined heating data is said first information if said combination is 00, is said second information if said combination is 01, and is said third information if said combination is 11.

15. A thermal printer as defined in claim 14, wherein said first information is 0, said second information is −1, and said third information is 1.

16. A thermal printer as defined in claim 14, wherein said even and odd number gradation counters output said gradation level data one after another in a manner increasing said gradation levels.

17. A thermal printer as defined in claim 16, wherein said drive signal generator includes:

a strobe signal generator for generating a strobe signal at a period of powering for each one of said gradation levels;

an even number counter for generating an even count signal if a strobe signal number of strobe signals is even;

a first latch array, connected with said first shift register, for latching said even number gradation heating data in response to said even count signal;

an odd number counter for generating an odd count signal if said strobe signal number is odd;

a second latch array, connected with said second shift register, for latching said odd number gradation heating data in response to said odd count signal;

an OR gate array, supplied with said even and odd number gradation heating data by said first and second latch arrays, for outputting said drive signal.

* * * * *